United States Patent [19]

Coplin et al.

[11] 4,101,242

[45] Jul. 18, 1978

[54] MATCHING THERMAL EXPANSION OF COMPONENTS OF TURBO-MACHINES

[75] Inventors: John Frederick Coplin, Duffield; Anthony Butler, Belper; Peter Frederick Neal, Donington, all of England

[73] Assignee: Rolls-Royce Limited, Derby, England

[21] Appl. No.: 692,051

[22] Filed: Jun. 2, 1976

[30] Foreign Application Priority Data

Jun. 20, 1975 [GB] United Kingdom ..... 26427/75

[51] Int. Cl.[2] ..... F01D 1/04; F01D 5/08; F01D 25/08; F01D 25/26

[52] U.S. Cl. ..... 415/134; 415/178; 415/199.5; 415/218

[58] Field of Search ..... 415/134, 137, 139, 177, 415/178, 174, 199.5, 208, 210, 218

[56] References Cited

U.S. PATENT DOCUMENTS

| | | | |
|---|---|---|---|
| 2,749,026 | 6/1956 | Hasbrouck et al. | 415/218 |
| 2,859,934 | 11/1958 | Halford et al. | 415/137 X |
| 3,093,361 | 6/1963 | Hooker et al. | 415/177 |
| 3,303,998 | 2/1967 | Koff et al. | 415/218 X |
| 3,304,054 | 2/1967 | Oechslin et al. | 415/134 |
| 3,602,605 | 8/1971 | Lee et al. | 415/177 X |
| 3,656,862 | 4/1972 | Rahaim et al. | 415/174 X |
| 3,701,536 | 10/1972 | Matthews et al. | 415/174 X |
| 3,892,497 | 7/1975 | Gunderlock et al. | 415/134 |
| 3,966,354 | 6/1976 | Patterson | 415/134 X |

FOREIGN PATENT DOCUMENTS

| | | | |
|---|---|---|---|
| 451,789 | 10/1948 | Canada | 415/137 |
| 955,995 | 7/1949 | France | 415/134 |
| 1,382,232 | 11/1964 | France | 415/178 |
| 261,715 | 1/1927 | United Kingdom | 415/177 |

*Primary Examiner*—Carlton R. Croyle
*Assistant Examiner*—Donald S. Holland
*Attorney, Agent, or Firm*—Cushman, Darby & Cushman

[57] ABSTRACT

A turbo-machine casing comprises a part double skinned portion at a location surrounding at least one stage of rotor blades; the spaces defined between the two skins containing a heat insulating medium, and the inner of the two skins being additionally provided upon its radially innermost surface with a lining of heat insulating material, the casing being connected to a mass disposed radially outwardly of the casing whereby the rate of thermal expansion of the casing can be reduced nearly equal to the bladed rotor which it surrounds.

8 Claims, 3 Drawing Figures

MATCHING THERMAL EXPANSION OF COMPONENTS OF TURBO-MACHINES

BACKGROUND OF THE INVENTION

The present invention relates to turbo-machines, for example gas turbine engines.

During the transient conditions of operation of such machines the temperature of the working fluid in the machine varies relatively quickly, causing those parts of the machine which are close to the working fluid passages to heat up and cool down. For example, in a gas turbine engine compressor or turbine which has a bladed rotor comprising blades mounted on discs and disposed within a casing, the casing is in direct contact with the air or hot gas flowing through the machine and tends to heat up relatively quickly during accelerations of the engine. The rotor discs, however, which are relatively more massive and which are shielded from the hot air by blade platforms and inter-stage spacers, heat up less quickly. The result is differential thermal expansion between the casing and the tips of the rotor blades, carried by the discs, and a consequent loss in efficiency.

It is an object of the present invention to provide a turbo-machine, which is constructed in such a manner that the thermal expansions of the rotors and casings thereof are more nearly matched.

SUMMARY OF THE INVENTION

According to the present invention a turbo-machine comprises a bladed rotor surrounded by a casing which is adapted to receive the roots of stator vanes which are disposed between axially spaced rows of rotor blades of the rotor, and wherein the casing is double walled at locations surrounding the stator vanes and surrounding at least one row of rotor blades, the two walls defining therebetween spaces for containing a heat insulating medium, the inner of the two walls at the location of said rotor blade row being additionally provided with a lining of heat insulating material on its radially inner surface, and the casing being connected at least at one axial location to a mass disposed radially outwardly of the casing, whereby the rate of thermal expansion of the casing can be reduced nearly equal to that of the bladed rotor which it surrounds.

Preferably the spaces defined between the double walls of the casing contain air as an insulating medium.

Alternatively the spaces defined between the double walls of the casing contain asbestos as an insulating medium.

According to one aspect of the invention the mass disposed radially outwardly of the casing is a rigid outer casing to which the casing is rigidly connected at axially spaced apart intervals.

According to a further aspect of the invention the mass disposed radially outwardly of the casing is a rigid outer casing to which the casing is connected by means of attenuation links or cones such as to isolate the casing from any deformation occurring in the radially outwardly disposed mass.

BRIEF DESCRIPTION OF THE DRAWINGS

Examples of the invention will now be more particularly described with reference to the accompanying drawings, in which.

DESCRIPTION OF THE PREFERRED EMBODIMENTS

Figure 1:
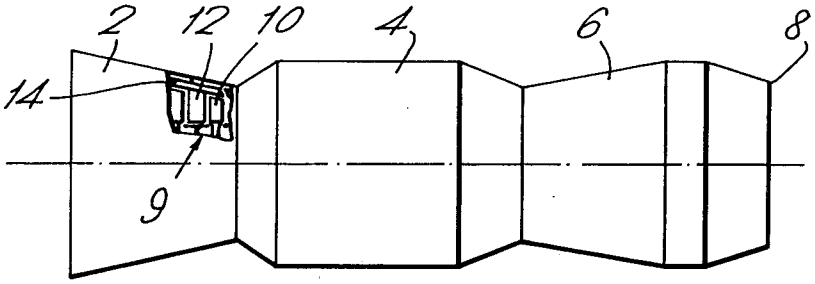
FIG. 1 is a diagrammatic representation of a gas turbine engine which is partly sectioned to illustrate the casing surrounding the compressor thereof.

Referring now to the drawings there is shown in FIG. 1 a gas turbine engine comprising a compressor section 2, a combustion section 4, a turbine section 6, and a nozzle 8, all in flow series. The compressor section comprises a bladed rotor, generally designated at 9, having a plurality of rows of rotor blades 10 and stator vanes 12 within a casing shown generally at 14.

Figure 2:
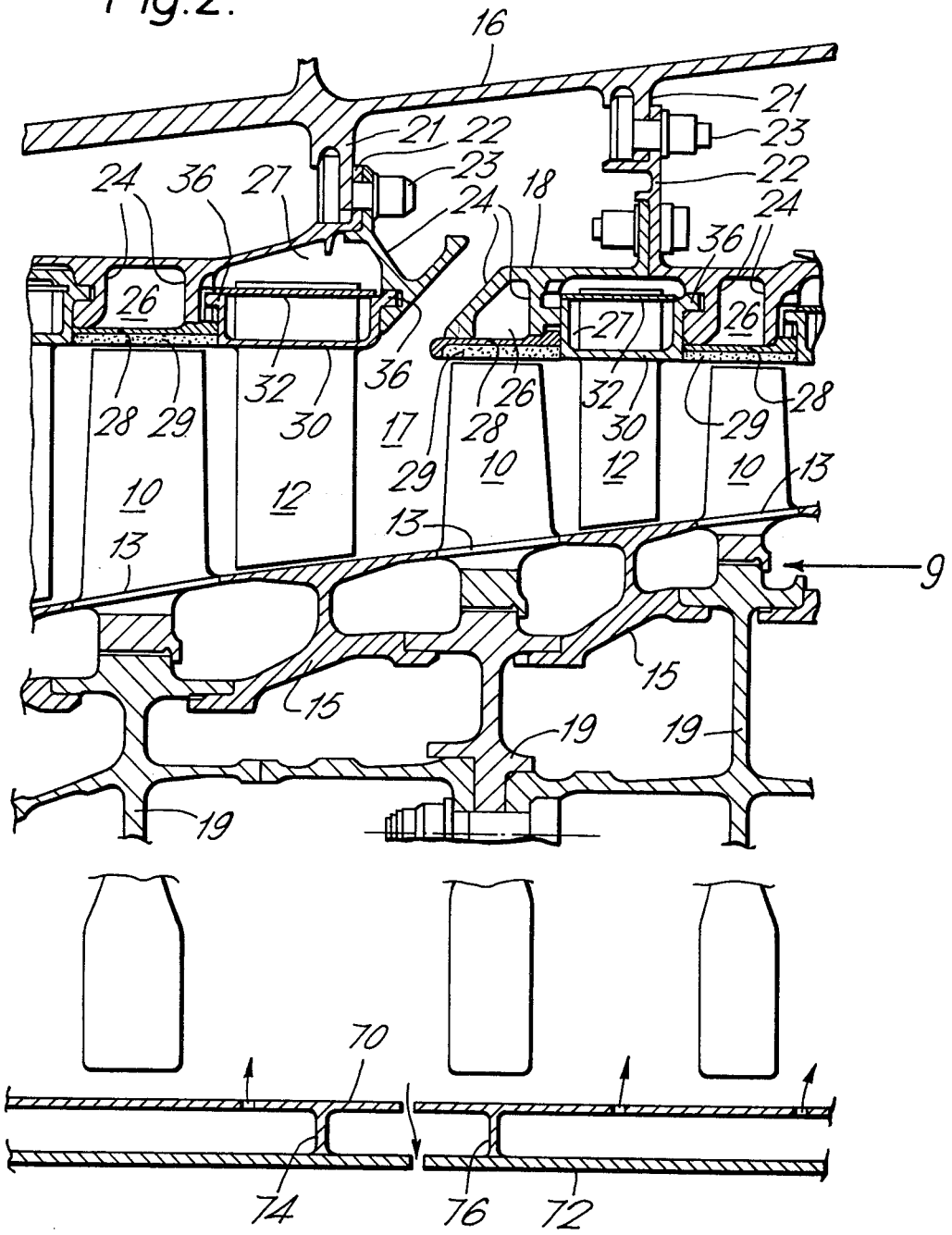
FIG. 2 is an enlarged sectional elevation of the compressor of FIG. 1 and, FIG. 3 is a sectional elevation of an alternative form of compressor construction.

Greater detail of the compressor can be seen in FIG. 2. The casing comprises an outer casing 16 and an inner casing 18. The rotor blades and stator vanes are disposed in a gas flow passage 17 defined between the inner casing 18 and a further radially inner wall which is defined by platforms 13 on the rotor blades 10 and spacer rings 15 which extend between the rotor discs 19. The outer casing 16 is sufficiently spaced from the inner casing 18 so that it remains relatively cool and is not heated directly by the hot gases in the gas flow passage 17. In some engines the outer casing may be washed by a comparatively cool by-pass flow of air over its outer surface which helps to maintain the temperature of the casing at a significantly lower level than that of the walls of the gas flow passage.

The outer casing 16 is connected to an outer wall of the inner casing 18 by means of a plurality of axially spaced stiff flanges 21 and 22 on the outer and inner casings respectively, and which are bolted together by bolts 23. These flanges present a heat flow path of relatively small cross-sectional area between the inner and outer casings.

The inner casing 18 has a plurality of circumferential flanges 24 which extend inwardly from the outer wall and which define with the said wall a plurality of radially inwardly facing open channels 26 which extend circumferentially around the casing. The channels 26 are positioned on the casing so that they surround the tips of the rotor blades 10 when the compressor is assembled.

The radially outer wall of the gas flow passage 17 is defined by a plurality of steel rings 28 which encircle the rotor blades 10, and which are disposed between the platform rings 30 of the stator vanes 12. The rings 28 serve to close the openings of the channels 26 to form substantially closed chambers therewith. The rings 28 are also provided with a liner 29 made from a material having high heat insulating properties for example, the material sold under the trade name of FELTMETAL, and which are brazed to the rings. Alternatively the rings are themselves made from a material having high heat insulating properties.

Between the channels 26, the flanges 24 also provide channels 27 in which the roots of the stator vanes 12 are received. The roots of the stator vanes are brazed into slots in a ring 32 and also into slots in the platform ring 30. The platform rings 30 are in the form of outwardly facing, U-shaped channels, the radially outwardly extending legs of which are provided with axially extending flanges or dogs 36 which are engaged in corresponding slots in the flanges 24. The platform rings 30 close the openings of the channels 27 and form substantially closed chambers therewith.

The air chambers surrounding the rotor blades and stator vane rows may be vented to prevent an undesirable build up of pressure therein.

If desired, the radially inner surface of the platform ring 30 may also be lined with heat insulating material.

With a casing constructed as described above, heat from the gas in the gas flow passage 17 is insulated from the casing 18 in the first instance by the insulating liners 29 on the rings 28 and on the platform ring 30 (if provided) which slows down the rate of heat transfer to the rings 28 and the platform rings 30. The only heat conducting paths between the rings 28 and 30 and the casing 18 are through the flanges 24, which have only a small area of contact with the rings. In the channel-shaped spaces 26 and 27 between the flanges 24 the almost stagnant air pockets insulate the casing 18 from the rings.

Thus the rate of heat flow into the inner casing 18 is very limited, and during transient operations of the engine the wall heats up at a rate nearly equal to that of the discs 19 of the rotor which are shielded from the hot gases by the inner wall of the gas passage.

A further restraint is put on the expansion of the inner casing 18 by the outer casing 16 and the stiff flanges 21 and 22. Since the outer casing 16 can be made to be relatively massive and since by virtue of its position, it is also relatively cool, its rate of thermal expansion is significantly less than that of the inner casing. The radially outward expansion of the inner casing is thus restrained by the slower expansion of the relatively cool large mass of the outer casing and its flanges to which the inner casing is connected.

It is possible that if the outer casings is deformed into an out-of-round shape, either during manufacture or assembly in the engine, that this deformation can cause deformation of the inner casing through the rigid flange connections 21 and 22, and this would prevent the full benefit of the matching of the thermal expansions of the rotor and casing being obtained.

Figure 3:
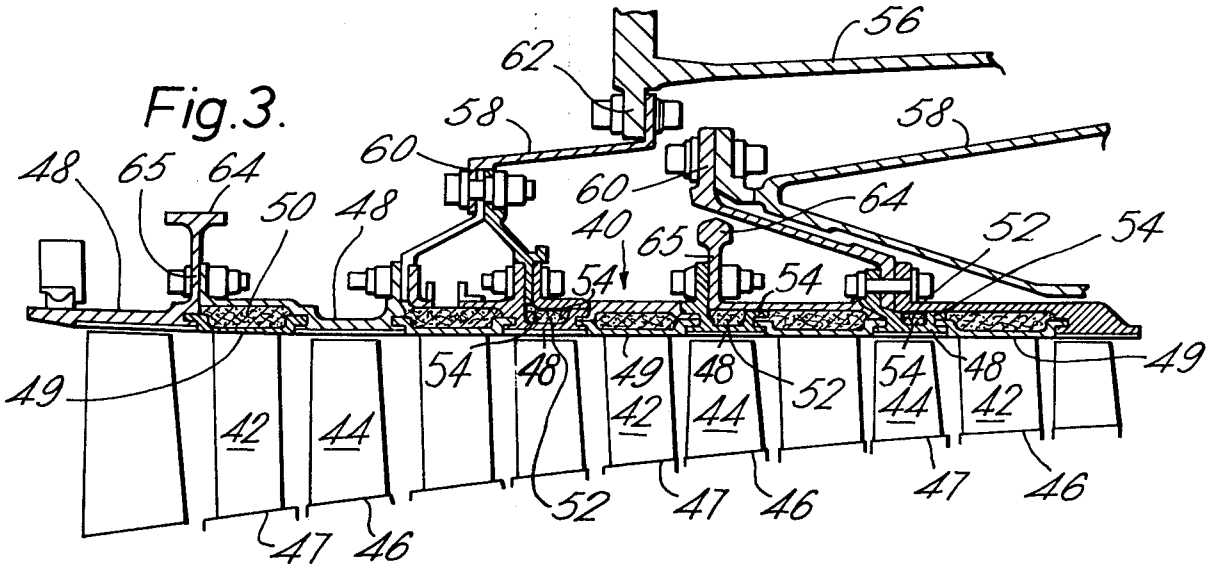

An alternative casing construction is illustrated in FIG. 3 which overcomes this problem. In FIG. 3 there is shown a compressor having an inner casing 40 surrounding a bladed rotor, and adapted for receiving the roots of stator vanes 42. An air passage through the rotor blades 44 and stator vanes is defined between the radially inner surface of the casing 40 and platforms 46 and 47 on the rotor blades and stator vanes respectively. The radially inner wall of the casing is made up of rings 48 axially spaced to surround the tips of the rotor blades 44 and between which are further platforms 49 on the radially outer ends of the stator vanes 42.

The casing is made so as to be effectively double walled to provide air spaces 50 around the stator blade roots and air spaces 52 around those rotor blades at the downstream end of the compressor. The air spaces 50 are formed between the radially outwardly facing channel shaped platforms 49 on the stator vanes and the casing wall, while the spaces 52 are formed by providing the rings 48 surrounding the rotor blades with radial flanges 54 which define radially outwardly facing channels which are closed by the casing wall.

Thus as in the earlier described embodiment the air in the spaces 50 and 52, which is a good insulating medium, reduces the rate of heat flow to the casing. The spaces 50 surrounding the stator blade roots in this embodiment are additionally filled with an insulating material such as asbestos, in the form of a tape, to provide added insulation against heat flowing into the casing. The spaces 52 surrounding rows of rotor blades are also filled with insulating material such as asbestos.

Also as in the earlier described embodiment the rings 48 are provided with a lining of a light weight heat insulating material such as FELTMETAL.

The inner casing 40 is connected to an outer casing 56 through attenuation links or shallow cones 58 which are bolted to flanges 60 on the inner casing and to flanges 62 on the outer casing. These links 58 isolate the inner casing from deformations of the outer casing by virture of the fact that the links are relatively flexible such that they absorb any radial deformation which may occur.

As a further measure for reducing the tip clearance changes between the rotor blades and the casing additional masses are connected to the casing on the side remote from the gas flow passage. These masses take the form of rings 64 surrounding the casing and are conveniently formed as enlargements of flanges 65 at which sections of the compressor are bolted together. These rings 64 serve two purposes. Firstly they stiffen the casing to reduce its tendency to deform into an out-of-round condition, and secondly they act as additional thermal masses which, being relatively cool on the outside of the casing, and relatively massive, have a lower rate of thermal growth than the casing, and restrain the expansion of the casing still further.

Thus by a combination of insulation and increased thermal mass on the casing much better matching of the rates of thermal expansion of the rotor and casing can be achieved.

Still further refinements may be made to improve the thermal matching of the rotor and casing. For example, as shown in the FIG. 2 embodiment an additional tube 70 may be provided which surrounds the air vent tube 72 adjacent the engine axis and is sealed to the tube 72 at two locations 74 and 76. Relatively hot air from the higher pressure parts of the engine can be fed into the downstream end of the tube 70 which is provided with circumferentially spaced holes from which the air is discharged in jets into the spaces between the discs to heat the discs. Lower pressure air at lower temperature is supplied to the upstream end of the tube and is discharged in jets through holes in the tube into the spaces between the upstream discs. The two air flows are mixed and vented through central apertures in the tube to be passed into the general air system of the engine.

Additionally, if the region between the inner and outer casings is heated by air bled or leaking from the compressor a layer of insulation may also be provided on the outer surface of the inner casing. For example, magnesium zirconate may be sprayed onto the surface.

What we claim is:

1. An axial flow compressor for a gas turbine engine comprising:

a bladed rotor including a plurality of axially spaced rows of rotor blades;

a casing surrounding said bladed rotor;

a plurality of axially spaced rows of stator vanes disposed between the rows of rotor blades, said rows of stator vanes having roots supported by said casing;

said casing having an inner wall and a radially spaced outer wall at locations surrounding the rows of stator vanes and surrounding at least one row of rotor blades; said inner wall including a first plurality of continuous and unsegmented platform rings with each one of said platform rings extending about and supporting a row of stator vanes and a second plurality of continuous and unsegmented rings disposed between said platform rings and extending about and spaced from each of said rows of rotor blades, said inner wall and said outer wall being spaced from each other by radially extending flanges defining spaces surrounding the roots of the rows of stator vanes and surrounding the rows of rotor blades;

a heating insulating medium in each of said spaces;

a lining of heating insulating material on a radially inner surface of each of said second plurality of rings at a location of said rows of rotor blades;

a rigid mass spaced radially outwardly of and extending around said casing, said mass being relatively cool with respect to said casing and having a lower rate of thermal expansion than a rate of thermal expansion of said casing; and means rigidly connecting said mass to said casing whereby said inner wall of said casing as defined by said first and second plurality of rings are restrained in their expansion and prevented from getting out of round by said rigid mass so that at least said second plurality of rings have a rate of expansion substantially equal to a rate of expansion of said bladed rotor.

2. An axial flow compressor as claimed in claim 1 in which said heating insulating medium in each of said spaces surrounding the roots of the rows of stator vanes and surrounding the rows of rotor blades is air.

3. An axial flow compressor as claimed in claim 1 in which said heating insulating medium in each of said spaces surrounding the roots of the rows of stator vanes and surrounding the rows of rotor blades is asbestos.

4. An axial flow compressor as claimed in claim 1 in which said rigid mass spaced radially outwardly of and extending around said casing is an outer casing, and in which said means rigidly connecting said mass to said casing includes a plurality of axially spaced flanges extending between the outer wall of said first mentioned casing and said outer casing.

5. An axial flow compressor as claimed in claim 1 including an outer casing radially spaced from said casing surrounding the bladed rotor and means for supporting said outer casing radially outwardly of said first mentioned casing, said last mentioned means being flexible for absorbing any radial deformation of said outer casing.

6. An axial flow compressor as claimed in claim 5 wherein said rigid mass includes a ring-shaped member positioned between the outer casing and said first mentioned casing and in which said means rigidly connecting said mass to said first mentioned casing is at least one outwardly extending flange from the outer wall of said first mentioned casing.

7. An axial flow compressor as claimed in claim 6 in which said means for supporting said outer casing radially outwardly of said first mentioned means includes flexible attenuation links.

8. An axial flow compressor as claimed in claim 6 in which said means for supporting said outer casing radially outwardly of said first mentioned casing includes flexible shallow cones.

* * * * *